US005875381A

United States Patent [19]

Moser

[11] Patent Number: 5,875,381

[45] Date of Patent: Feb. 23, 1999

[54] RELEASE AGENT APPLIED TO FUSER ROLL VIA PAPER

[75] Inventor: Rabin Moser, Victor, N.Y.

[73] Assignee: Xerox Corporation, Stamford, Conn.

[21] Appl. No.: 4,634

[22] Filed: Jan. 8, 1998

[51] Int. Cl.[6] ..... G03G 15/20

[52] U.S. Cl. ..... 399/324; 399/328; 430/124

[58] Field of Search ..... 399/324, 325, 399/328; 118/60, DIG. 1; 430/99, 124; 347/156

[56] References Cited

U.S. PATENT DOCUMENTS

| | | | |
|---|---|---|---|
| 3,716,221 | 2/1973 | Gorka et al. | 118/60 |
| 4,214,549 | 7/1980 | Moser | 118/60 |
| 4,309,957 | 1/1982 | Swift | 118/60 |
| 4,770,116 | 9/1988 | Moser | 118/60 |
| 5,392,105 | 2/1995 | Moser | 399/324 |
| 5,465,146 | 11/1995 | Higashi et al. | 399/328 |
| 5,761,597 | 6/1998 | Smith et al. | 399/324 X |

*Primary Examiner*—Arthur T. Grimley
*Assistant Examiner*—Sophia S. Chen
*Attorney, Agent, or Firm*—Benjamin B. Sklar; Robert A. Chittum

[57] ABSTRACT

A heat and pressure fuser and Release Agent Management (RAM) systems therefor. The RAM system deposits release agent material on toner images on a substrate such as plain paper. The RAM system includes a rigid metering roll and a pressure roll supported for pressure engagement to form a nip through which a substrate carrying the toner images passes with the toner images contacting the metering roll. Release agent material is applied to the metering roll from a supply with subsequent transfer primarily to the toner images on the substrate.

17 Claims, 1 Drawing Sheet

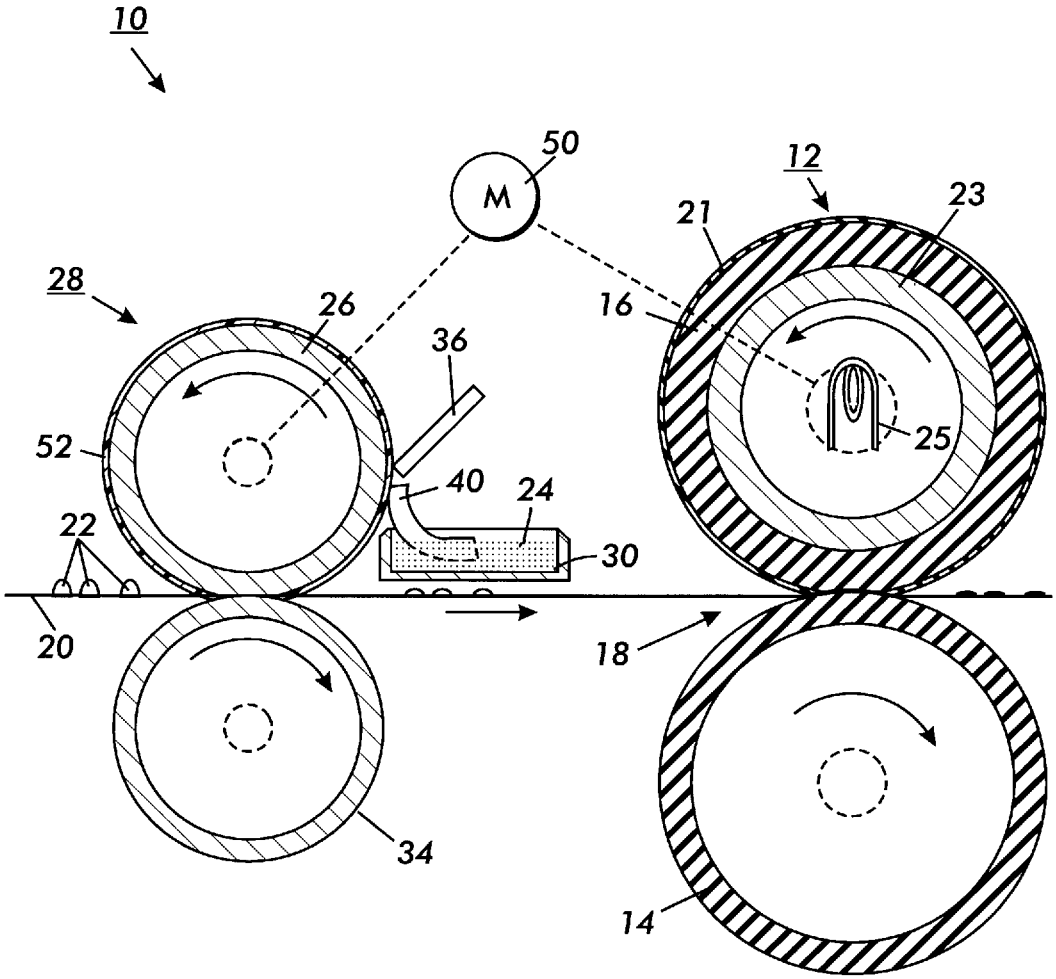
10
50
M
12
21
23
28
26
16
36
25
52
40
24
22
30
20
18
34
14

RELEASE AGENT APPLIED TO FUSER ROLL VIA PAPER

BACKGROUND OF THE INVENTION

This invention relates generally to a heat and pressure fuser for an electrophotographic printing machine, and more particularly the invention is directed to release agent application methods and apparatus therefor.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a Nip Forming Fuser Roll (NFFR) fuser, the heated fuser roll is provided with a layer or layers that are deformable by a harder pressure roll when the two rolls are pressure engaged. The length of the nip determines the dwell time or time that the toner particles remain in contact with the surface of the heated roll. In a Nip Forming Pressure Roll (NFPR) fuser the pressure roll is provided with a deformable outer layer which is deformable by the harder fuser roll.

The heated fuser roll is usually the roll that contacts the toner images on a substrate such as plain paper. In any event, the roll contacting the toner images is usually provided with an abhesive (low surface energy) material for preventing toner offset to the fuser member. Three low surface energy materials which are commonly used for such purposes are PFA (PerFluoroAlkoxy resin), VITON™, a fluoroelastomer based on the copolymer of vinylidene fluoride and hexafluoropropylene, and silicone rubber. All of these materials, in order to maintain their abhesive qualities, require release agents specific to the material.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

Heretofore, the methods of using release agent materials for preventing offset of toner material to contact fuser members has been to apply a coating of release agent material to the heated fuser member which contacts the toner images. This has been accomplished as described in the prior art in various ways.

RAM systems of the prior art are, in one way or another, subjected to excessive amounts of heat. This is primarily because they have to operate in close proximity to a large source of heat such as the heated fuser roll. Such RAM systems result in various shortcomings such as: the RAM acting as a thermal drain on the fuser roll thereby causing the phenomena known as droop at cold and hot startup, release agent degradation due to exposure to high temperatures, nonuniformity of oil application between copy 1 and copy N, necessity of using high operating temperature and highly abrasive materials for the metering blade, unnecessary heat dissipation into the machine and undesirable amounts of release oil on substrates such as plain paper etc.

Donor/metering roll Release Agent Management (RAM) systems have been used as part of a roll fuser apparatus for some time. Such a RAM system is disclosed in U.S. Pat. No. 4,214,549 issued on Jul. 29, 1980 to Moser. This patent illustrates a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The pressure roll is the softer of the two rolls, therefore, the nip is formed by the harder fuser roll indenting the softer pressure roll. The heated fuser roll is characterized by an outer layer or surface which by way of example is fabricated from a silicon rubber or a fluoroelastomer such as VITON™ to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

U.S. Pat. No. 4,770,116 granted to Rabin Moser on Sep. 13, 1988 relates to a heat and pressure roll fusing apparatus for fixing toner images to copy substrates, the toner comprising a thermoplastic resin. The apparatus includes an internally heated fuser roll cooperating with an unheated bare metal backup or pressure roll to form a nip through which the copy substrates pass with the images contacting the heated roll. The heated fuser roll is characterized by a conformable outer layer or surface which by way of example is fabricated from a silicone rubber or a fluoroelastomer such as VITON™ to which a low viscosity polymeric release fluid is applied. Release fluid is contained in a sump and the pressure roll is partially immersed in the fluid. Thus, the release fluid is applied to the surface of the internally heated fuser roll via the bare metal pressure roll. The roll structures are such as to provide maximum area of contact in the nip, while minimizing the area of contact between the pressure roll and the copy substrates.

U.S. Pat. No. 5,392,105 granted to Rabin Moser on Feb. 21, 1995 relates to a applying a release agent material which is solid at room temperature. The release agent material is contained in a sump for application indirectly to a heated fuser roll structure. A pressure roll structure contacts the solid release agent material and a source of heat energy serves to elevate the solid release agent material to its operating temperature which is well below the operating temperature of the heated fuser roll. A metering blade contacting the pressure roll structure causes the liquefied release agent material to be metered to the desired thickness.

U.S. Pat. No. 3,716,221 granted to Gorka et al on Feb. 13, 1973 relates to a fusing device for fusing thermoplastic resinous particulate material to a receptor sheet. The fusing device includes a fusing roller having a resilient fusing blanket supported on the periphery thereof and heating means to heat the fusing blanket to a temperature sufficient to fuse the particulate material. A backup roller is urged toward engagement with the deformable fusing blanket to press the receptor sheet carrying the particulate material into contact with the fusing roller. The fusing roller is coated with an off-set preventing liquid which is applied thereto from the backup roller at predetermined intervals during operation of the fusing device.

U.S. Pat. No. 4,309,957 granted to Joseph A. Swift on Jan. 12, 1982 relates to a improved fluid applicator wick for use in applying release fluids to a fuser member surface of a fusing system for fusing toner images is described. The wick comprises a working surface material which contacts the fuser member surface, and a backing material to which the working surface material is needled. A preferred fluid applicator wick comprises a layer of felt or fiber made from a tetrafluoroethylene fluorocarbon polymer, sold under the trademark TEFLON™, as a working surface material which is needled to a fibrous or felted aramid material, such as that sold under the trademark NOMEX™. One side of the wick contacts a release agent or fluid supply means such as an applicator roll, a spray of release fluid, a reservoir of release fluid.

BRIEF SUMMARY OF THE INVENTION

In accordance with the present invention, a pair of rigid, nonconformable rolls, similar to the metering roll in a donor/metering roll Release Agent Management (RAM) system ('549 patent) are pressure engaged to provide an oil delivery nip that applies release agent to the images of an imaged substrate prior to the imaged substrate being subjected to a heat and pressure fuser apparatus. The release agent material applied to the substrate coats the images thus placing a low surface energy thereon. The low surface energy material on the images forms a barrier between the toner particles forming the images and roll surfaces such as a heated fuser roll surface for fixing the toner images to the substrate. Observed advantages of such a Release Agent Management (RAM) system are: RAM does not act as a thermal drain on the fuser roll thereby minimizing droop at cold and hot startup, the release agent sump is not subjected to the high fuser roll temperatures thereby eliminating release agent degradation, improved oil uniformity between copy 1 and copy N, allows use of lower temperature, less abrasive materials for the metering blade, capability of providing controlled back tension for wrinkle control, with a low temperature sump toner does not stick to the wick or compact against the wick or blade, reduced heat dissipation into the machine and more oil on the image than on paper etc.

The roll pair may comprise a pair of steel rolls or a steel roll and plastic-surfaced roll with a thin layer of nylon or TEFLON™. In any event, neither roll exhibits substantial conformability to substrates such as plain paper thereby effecting transfer of oil primarily to the toner images and not to the paper. Minimal quantities of release agent are transferred to the paper while an adequate amount is transferred to the toner.

Typical cold pressure fusers operate at a nip pressure of about 2500 psi which causes calendaring of the paper. Typical heated roll fusers operate at a nip pressure of about 150 psi which does not cause noticeable calendaring of paper. The rolls according to the invention operate in the 200 to 1000 psi range without causing paper calendaring. At least, the roll contacting the images is constructed in a manner similar to the metering roll in donor/metering roll arrangement in the '549 patent.

A metering blade is provided for effecting proper metering of oil on the roll contacting the toner images. The blade material may comprise polyurethane since it will not be subjected to the higher temperatures to which prior art blades are subjected.

DESCRIPTION OF THE DRAWING

The FIGURE is a schematic representation of a heat and pressure fuser incorporating the invention.

DESCRIPTION OF THE PREFERRED EMBODIMENT(S) OF THE INVENTION

Disclosed in the Figure is a heat and fuser structure 10 incorporating certain features of the present invention. As disclosed in the Figure, the fuser structure 10 comprises a Nip Forming Fuser Roll (NFFR) fuser including a heated fuser roll member 12 and a pressure roll 14. In the NFFR fuser 10, the heated fuser roll 12 comprises a deformable layer 16 which under pressure applied between the harder pressure roll and softer fuser roll deforms to form an elongated nip 18 through which a substrate 20 such as plain paper carrying toner images 22 passes. As will be appreciated, the present invention is also suitable for Nip Forming Pressure Roll (NFPR) fusers wherein the pressure roll member comprises the deformable outer layer.

The heated fuser roll member 12 comprises a rigid core 23 to which the outer elastomeric layer 16 is adhered. The layer 16 may comprise silicone rubber or VITON™, a fluoroelastomer material based on the copolymer of vinylidene fluoride and hexafluoropropylene. The layer 16 may contain metal oxide particles which interact with a polymeric release agent material 24 to provide an interfacial barrier layer between the fusing surface and the toner. The layer 16 is fabricated and adhered to the core 23 in accordance with one of a number of well known processes. Multiple layer fuser rolls are also contemplated. The heated fuser roll structure 12 may also comprise a thin outer coating 21 of VITON™, particularly when the layer 16 comprise silicone rubber. The temperature of the fuser roll 12 is elevated by means of a quartz heater 25 disposed internally of the core 23.

The release agent material 24 comprises a functional release agent material containing a relatively high concentration in the order of 0.05 to 0.3 mole % of functional chains which attach to the metal oxide particles.

In the case of a metal oxide filled Viton™ layer, mercapto functional oil is used for interaction with the oxide particles. In this case, the mercapto functional oil bonds to the oxide particles. When the layer is not filled with metal oxide particles, an amino functional oil is used. In this case, the amino functional oil bonds with the Viton™. The amino functional oil may also be used with a layer 21 which does not contain oxide particles. Other materials such as silicone rubber may also be employed as the surface of the fuser roll.

The functional release agent material 24 is supplied to the surface of the a metering roll 26 by means of a RAM system 28 comprising a sump 30 containing a quantity of the polymeric release agent material 24.

Suitable release agent materials for use in RAM system 28 comprise a functionalized polymeric release agent, such as mercapto-functional polyorganosiloxane. The metal oxide particles contained in a metal oxide filled elastomer layer 16 are in an amount sufficient to interact with the polymeric release agent 24 which comprises sufficient (i.e. 0.05 to 0.3 mol %) functional chains to provide an interfacial barrier layer between said fusing surface and toner.

The RAM 28 system comprises a rigid pressure roll 34, the metering roll 26 conveying release agent material from the sump 30 to the toner images 22 on the substrate 20. A metering blade 36 contacting the metering roll in a chiseling orientation serves to meter the release agent material on the surface of the metering roll. The metering blade 36 is preferably fabricated form a material such as polyurethane.

A wick 40 one end of which is immersed in the release agent material 24 and the other end of which contacts the surface of the metering roll 26 serves to convey release agent material such as silicone oil from the sump 30 to the surface of the metering roll 26. The metering roll is preferably a nickel or chrome plated steel roll having a 4–32 AA finish. The metering roll has an outside diameter of 1 to 2 inches. As mentioned above, the metering roll is supported for rotation, such rotation being derived from an independent drive mechanism (not shown) or from mechanism operatively coupling it to the fuser roll drive mechanism, also not shown. A motor 50 operatively coupled to the aforementioned drive mechanisms serves to impart rotational movement to the metering roll 26 and heated fuser roll 12.

The blade functions to meter the release agent picked up by the roll 26 to a predetermined thickness, such thickness being of such a magnitude as to result in 1 to 5 microliters of release agent consumption per copy.

The contact between a typical copy substrate such as plain paper and a hard or non-conformable roll such as the metering roll 26 is very small (i.e. less than 10%). On the other hand, the area of contact between a conformable fuser roll and such a pressure roll is nearly 100%. Similarly, the conformability between the hard roll 26 and the toner material is quite high. Accordingly, the fuser oil can be continuously applied to the metering roll which will result in the desired amount of oil being deposited on the toner images and a minimum amount of oil being deposited onto the substrate. The metering roll 26 may be provided with a relatively thin (0.002 inch) sleeve 52 of abhesive or low surface energy material such nylon or PFA (PerFluoroAlkoxy resin). By abhesive is meant that the material has a low affinity of toner. Thus, the offset of toner to such a sleeve is minimized particularly in the presence of silicone oil.

I claim:

1. A heat and pressure fuser structure for use in an imaging apparatus, said fuser structure comprising:

a release agent management system including a metering member;

a pressure member supported for pressure engagement with said metering member to form a first nip through which substrates carrying unfused toner images are passed with the toner images contacting said metering member a heated fuser member;

a non-heated fuser member supported for pressure contact with said heated fuser member to form a second nip through which the substrates carrying toner images are passed with said toner images contacting said heated fuser member.

2. A heat and pressure fuser structure according to claim 1 wherein said metering member comprises rigid, nonconformable structure.

3. A heat and pressure fuser structure according to claim 2 wherein said rigid, nonconformable structure comprises a roll.

4. A heat and pressure fuser structure according to claim 3 wherein said roll is provided with an abhesive sleeve.

5. A heat and pressure fuser structure according to claim 4 wherein said pressure member comprises a rigid, nonconformable roll structure.

6. A method of fusing toner images to a substrate including the steps of:

passing a substrate carrying toner images into contact with a release agent metering member by passing said substrate through a nip formed by a pair of pressure engaged rolls, one of which comprises said metering member; and subsequently passing said substrate through a nip of a heat and pressure fuser.

7. The method according to claim 6 wherein said step of passing a substrate into contact with a release agent metering member is carried out by passing said substrate into contact with a metering member comprising a rigid roll.

8. The method according to claim 7 wherein said step of passing a substrate into contact with a release agent metering member is carried out by passing said substrate into contact with a smooth surfaced, rigid metering member.

9. The method according to claim 8 wherein said step of passing a substrate into contact with a release agent metering member is carried out by passing said substrate into contact with a smooth surfaced, rigid metering roll member.

10. The method according to claim 9 wherein said metering roll comprises a rigid core with an outer abhesive sleeve.

11. A method of fixing toner images to a substrate including the steps of applying release agent material to a substrate carrying unfused toner images by using a pair of pressure engaged members one of which contacts the unfused toner images and has a quantity of release agent material carried thereby; and using a heat and pressure fuser structure, fixing said toner images to said substrate.

12. The method of fixing toner images according to claim 11 said pressure engaged members comprise rigid, nonconformable members.

13. A The method of fixing toner images according to claim 12 wherein said pressure engaged members comprise rolls.

14. A The method of fixing toner images to a substrate according to claim 13 wherein said heat and pressure structure comprises a pair of nip forming fuser rolls.

15. In a method of fixing toner images to a substrate, the step including:

contacting unfused toner images carried by a substrate with release agent material by passing said substrate carrying said unfused toner images between a pair of pressure engaged rolls such that said unfused toner images contact one of said pressure engaged rolls.

16. The method according to claim 15 wherein said pressure engaged rolls are rigid, nonconformable rolls.

17. The method according to claim 16 wherein said one of said pressure engaged rolls comprises a thin outer sleeve of abhesive material.

* * * * *